United States Patent [19]

Duclos et al.

[11] Patent Number: 4,682,529

[45] Date of Patent: Jul. 28, 1987

[54] MODULAR DEVICES FOR LOADING CARTRIDGES ON BOARD AIRCRAFT

[75] Inventors: Didier A. Duclos, Maisons Alfort; Pierre F. Coutin, Paris, both of France

[73] Assignee: R. Alkan & Cie, France

[21] Appl. No.: 678,856

[22] Filed: Dec. 6, 1984

[30] Foreign Application Priority Data

Dec. 7, 1983 [FR] France ..... 83 19579

[51] Int. Cl.[4] ..... F41F 5/02

[52] U.S. Cl. ..... 89/1.51; 89/1.55

[58] Field of Search ..... 89/34, 1.51, 1.55, 1.56, 89/1.6, 1.812, 1.814; 102/505

[56] References Cited

U.S. PATENT DOCUMENTS 1,893,232 1/1933 Halsey ..... 89/1.55
2,421,491 6/1947 Gearon et al. ..... 89/1.51
3,404,782 10/1968 Ray ..... 89/1.51
3,430,533 3/1969 Kifor et al. ..... 89/1.51
4,524,670 6/1985 Billard et al. ..... 89/1.51

FOREIGN PATENT DOCUMENTS 67733 12/1982 European Pat. Off. ..... 89/1.55

*Primary Examiner*—Harold D. Whitehead
*Attorney, Agent, or Firm*—William A. Drucker

[57] ABSTRACT

A modular device for loading cartridges on board aircraft is provided equipped with pyrotechnique cartridges with electric detonator, formed from a combination of elements of small volume and low weight comprising a case means enclosing cartridges whose bases carry firing detonators and are fixed to a support plate with interposition, between the support plate and an insulating plate, a printed circuit comprising resilient zones on which are fixed the studs for firing said detonators.

5 Claims, 11 Drawing Figures

MODULAR DEVICES FOR LOADING CARTRIDGES ON BOARD AIRCRAFT

BACKGROUND OF THE INVENTION

1. Field of the Invention

In aviation different kinds of cartridges, are used, such as flare cartridges, explosive cartidges, decoy launching cartridges. They are generally cylindrical in shape and of different sizes, depending on their use and their power.

The present invention relates more particularly to decoy launching cartridges whose useful loads are intended for jamming radar or other detection means.

2. Description of the Prior Art

The best know and most widely used techniques at the present time rely on the sequential ejection of projectiles which free their useful load as close as possible to the aircraft which ejected them. These useful loads are of different natures and may for example be metallized glass "chaff" serving as radar reflector, or pyrotechnique devices which burn while emitting infrared radiation.

These loads are contained in a case which protects them and which comprises at its base the electric detonator for firing a pyrotechnique impeller capable of ejecting the useful load at a predetermined speed and distance. Considering the diversity of possible loads, it is easy to understand the advantage of being able to accurately identify before ejection the nature of the useful load contained in the cartridges, as will be explained further on.

the equipment of an aircraft generally comprises a device capable of receiving a sufficient number of cartidges. This device may be reloaded on the ground by replacing empty cases by new cartiridges. This technique based on the use of independent cartridges has drawback of requiring considerable time for handling the load of the carrying device.

In order to reduce this grounding time, chargers have already been constructed comprising a number of cartridges. These chargers may be loaded by the gunnery staff. They are reemployed after use. Because of their repeated use and the handling which results therefrom, they are relatively unsophisticated and heavy.

In some recent applications, the independent cartridges have been replaced by loading modules, each containing several loads. These new modules behave like a multiple cartridge. They reduce the setting up time but the replacement of a defective load or a load already fired is on the contrary very delicate and can in practice only be carried out in the factory. Since the number of active loads of the device is limited, the need to obtain maximum efficiency means that a module becomes practically unusable if it is incomplete, either because one of the loads is defective through a manufacturing fault, or even if it was fired during a previous flight. The operating costs which result therefrom are very high.

SUMMARY OF THE INVENTION

The present invention allies the advantages of the preceding techniques with the use of independent cartridges, but making them capable of being assembled in multicharge loading module form of a small weight with respect to conventional chargers. These modules further comprise a printed electric firing circuit, providing electronic identification by a binary code of the nature of the useful load contained in the cartridges. When the cartridges comprise a safety device, the modules in question are designed so as to use these safety devices.

The result of these arrangements is great ease and flexibility of use of the device.

BRIEF DESCRIPTION OF THE DRAWINGS

One embodiment of the device of the invention will be described hereafter with reference to the accompanying drawings in which.

DESCRIPTION OF THE PREFERRED EMBODIMENT

Figure 1:
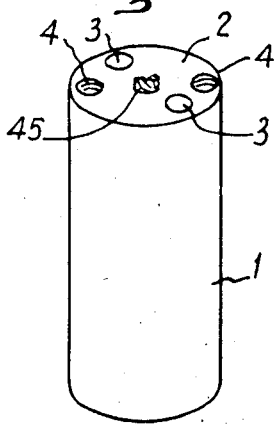
FIG. 1 is a perspective view of the specially equipped cartridge.
Figure 2:
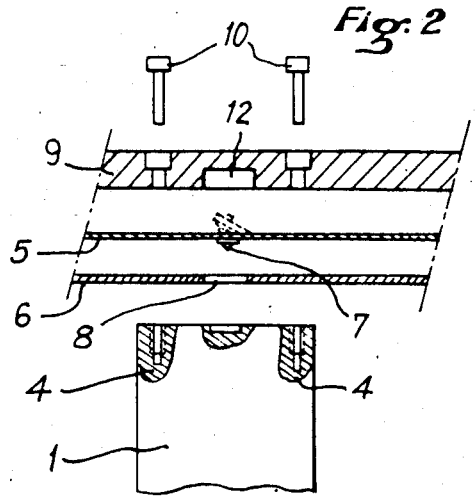
FIG. 2 shows the electric cartridge firing device.

In FIG. 1 can be seen at 1 the cylindrical cartridge, at 2 its base on which one or more firing detonators 3 are fixed. Two threaded holes 4 cooperating with two bolts 10 fix the cartridge to support 9 serving as support plate for firing (FIG. 2). A rotary wolf's tooth device 45 allows the internal safety device of the cartridge, if present, to be actuated.

In FIG. 2, we find again at 1 the cartridge, at 9 the support plate, at 10 the two fixing bolts corresponding to the threaded holes 4 (FIG. 1), at 5 the printed circuit for the electric supply of the cartridges, at 6 an insulating plate separating the printed circuit from the bases of the cartridges, at 7 a stud soldered to the printed circuit directly above each detonator, at 8 the hole formed in the insulating plate 6 for passing the stud therethrough and at 12 a recess for clearing the stud 7.

Figure 3:
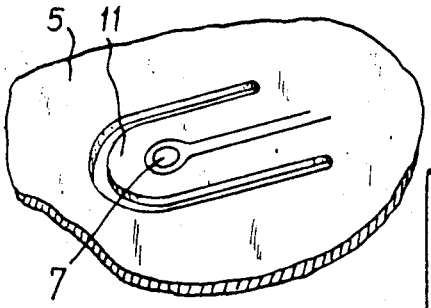
FIG. 3 shows the cut out of the printed circuit at right angles to the electric supply stud of a cartridge.

In FIG. 3 there is shown at 11 a cut out of the printed circuit 5 in the form of a tongue, on which stud 7 is located. This stud is thus on a resilient part and contact thereof with detonator 3 is provided by the stiffness of the tongue.

Figure 4:
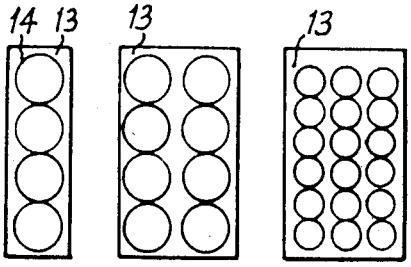
FIG. 4 shows examples of grouping cartridges containing loading modules.

In FIG. 4, cartridge arrangement examples have been shown forming different modules. At 13 is shown schematically a thin wall surrounding the assembly of cartridges, which wall is secured to the insulating part 6 so as to form a parallelepipedic box shaped part also comprising internal dividing walls 14 which locate and define the housing of the cartridges.

Figure 5:
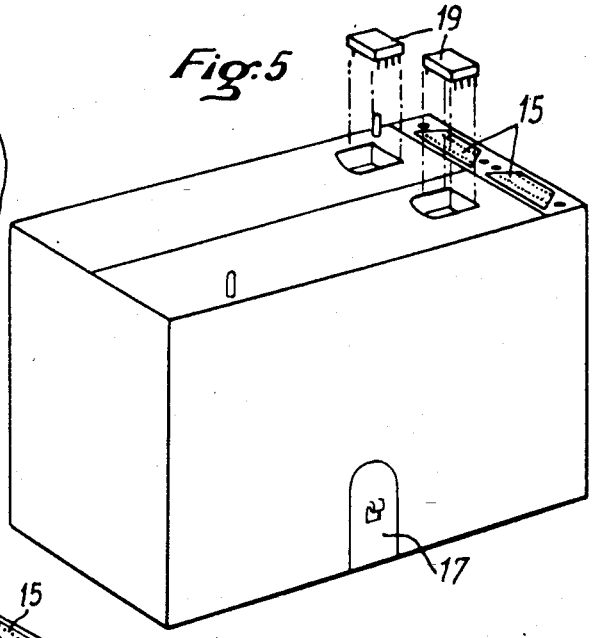
FIGS. 5, 6 and 7 are perspective views of a loading module showing schematically its external equipment.
Figure 6:
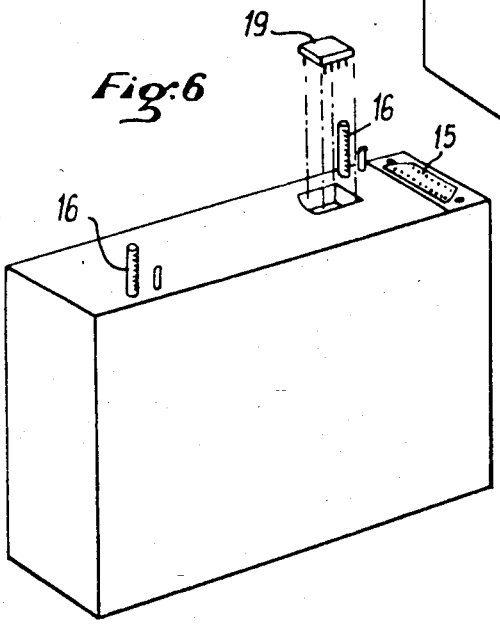

In FIGS. 5 and 6, at 15 have been shown the power supply connector or connectors to which studs 7 are connected, at 17 the threaded stud bolts for fixing the module to the carrying device fixed to the aircraft and at 19 an element containing coded connections (FIG. 5 shows a module with two rows of cartridges). Connector 15 may comprise special terminals on additional tracks of the printed circuit 5 for providing the desired codification. The fact of plugging into support 18 an element 19 in which the pins are connected together according to a binary code related to the load carried by the cartridges of the module informs, through connectors 15, the electronic control equipment which does not form part of the present invention.

A process for rapidly fixing the module to the carrying device of the aircraft may use bayonets 17, shown in FIG. 5. This process forms the subject of a separate patent application.

Figure 7:
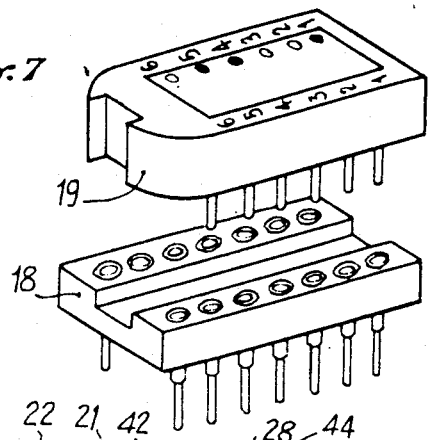

In FIG. 7 thereis shown at 18 a standard integrated circuit ship in connection with the printed circuit. This chip may have plugged therein an element 19 (FIG. 5) providing coding corresponding to the nature of the loads which the module comprises, as will be explained further on.

Figure 8:
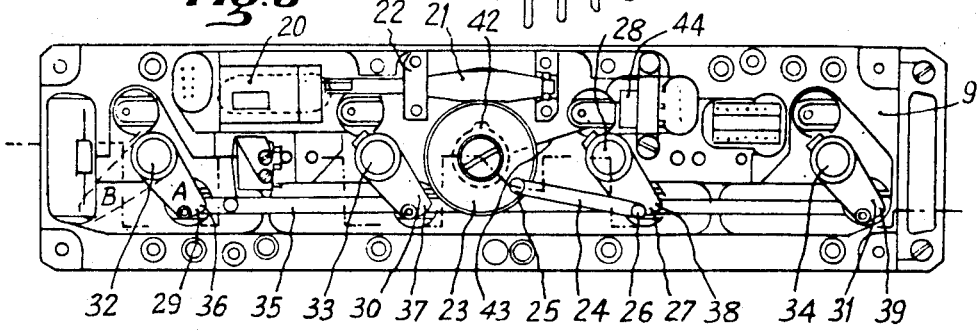
FIG. 8 is a top view of the mechanism for controlling the safety devices of the cartridges.

In FIG. 8 has been shown the safety mechanism of the cartridges with at 9 the bearing plate recessed so as to contain a flat electric motor 20 intended to drive an endless screw 21 rotating in bearing 22 for in its turn driving a toothed wheel 23. A link 24 is hingedly connected at 25 to wheel 23 and at 26 to a crank 27 itself pivoting on a fixed pin 28.

Three other cranks 29-30-31 pivot respectively on fixed pins 32-33-34. A link 35 connects together cranks 29, 30, 27 and 31 by means of articulations 36, 37, 38, 39.

Figure 9:
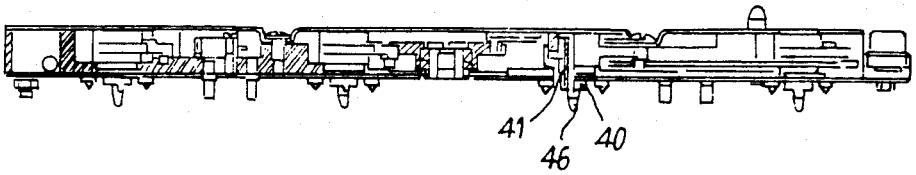
FIG. 9 is a longitudinal section of the mechanism for controlling the safety device of the cartridges.
Figure 10:
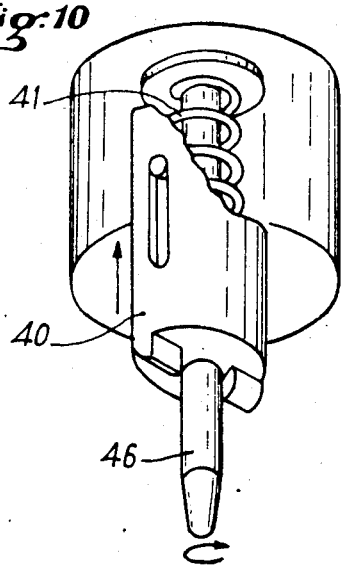
FIG. 10 is a perspective view showing the detail of the escape drive system of the safety device of the cartridges and FIG. 11 is a diagram showing the external electric control for restarting the motor controlling the mechanism of the safety device of the cartridges shown in FIG. 8.
Figure 11:
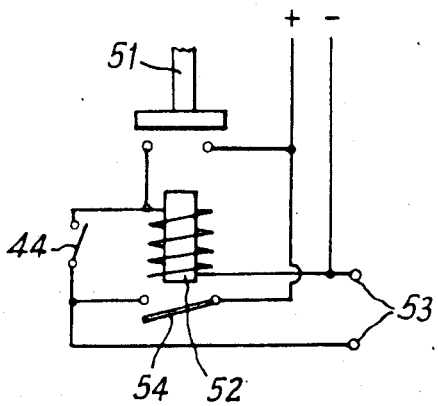

Each crank drives in rotation a wolf's tooth dog clutch, such as 40 (FIGS. 9 and 10), whose withdrawal is made possible against spring 41. The rotation of wheel 23 always takes place in the same direction, causing cranks 27, 29, 30 and 31 to swing alternately between the two endmost positions. Stopping in these endmost positions is obtained by cutting off the power supply by means of a cam 42 integral with wheel 23 on plate 43 controlling a switch 44. FIG. 11 shows an electric control diagram currently used for switching on motor 20 again after this motor has been stopped by the action of cam 42 on switch 44. A push button 51 energizes a self-feed relay 52 which then switches on motor 20 through terminals 53 by closure of the mobile contact 54 of this relay 52. Start up of the motor drives cam 22 which frees switch 44 while allowing closure thereof so that the action on the push button 51 may be relatively short.

The above indicated assembly, applied to a group of cartridges, allows a compact block to be formed called module, whose advantage resides in the small amount of space required for the constituent elements other than the cartridges themselves. The ratio between the volume of the useful load and the total volume is therefore increased. The same goes for the weight ratio.

The characteristics of space required and weight of a module thus designed may be further improved by using cartridges of square or rectangular section because of the better filling factor which results there from.

Furthermore, the possibility of forming elements 6, 13 and 14 as a single part means that this part may be advantageously obtained by injecting a plastic material into a mold, which improves the rigidity of the assembly and lowers its cost price.

This technique does not include the other processes; assembly of fine metal sheet elements for example.

The module thus designed is capable of receiving cartridges whose geometric interface characteristics are difined but whose useful load may be of different kinds. So as to provide an unequivocal relationship between the useful load of the cartridges and the module itself, binary codification has been provided using the printed circuit and connector 15. The pins used for this purpose are arranged in pairs. State 1 corresponds to the connection between two pins of one pair and state 0 to the absence of connection.

The assembly formed supplies to the electronic carrying system the identification of the module.

The codification desired may be obtained directly by short circuiting the pins concerned of the connector or by adding additional tracks to the printed circuit.

In order to further improve the ease of use of such a module, the coding part may be made removable. For this, a standard integrated circuit chip 18 is provided on the printed circuit (FIG. 7).

The coding part 19 (FIGS. 7 and 5) becomes independent. It is readily fixed manually to the assembly.

As has been mentioned, some cartridges are provided with a safety device, the positioning or withdrawal of which are effected with a mechanism whose visible part is formed by a rotary wolf's tooth device 45, FIG. 1. So as to be able to use this possibility, an electirc control device has been provided in the thickness of support plate 9 in connection with the rotary device of each cartridge (FIG. 8).

Switching on motor 20 through actuation of the push button 51 (FIG. 11) removes or repositions the safety device of each cartridge. The safety device is removed at the moment of firing the cartridges by rotating cranks 27, 29, 30 and 31 between the endmost positions A and B whose angular difference is about 90°. This safety device is reset after firing, particularly if all the cartridges have not been fired, by again switching on motor 20 which brings the cranks to the initial position A.

Should firing have locked the internal device of one of the cartridges, replacing of the safety device of the unfired cartridges is nevertheless provided for. So that the whole of the control is not blocked, the wolf's tooth clutch concerned 40 (FIG. 10) is raised because of the slope of the teeth against spring 41 and escapes without prevention the return of the other cartridges to the safety position. The force of spring 41 has been provided so that the escape cannot occur for normal operation of the non locked safety devices.

Accessorily, the rotary wolf's tooth member 45 (FIG. 1) of the cartridge comprises a small central bore in which is fitted the centering stud 46 (FIG. 10) provided on each wolf's tooth clutch of the control device for providing coincidence of the axes.

What we claim is:

1. A modular device for carrying by an aircraft load launching cartridges, such cartridges each having a base provided with threaded holes for its securing and electric detonators for initiating the load ejection, said modular device comprising:

(a) a box with internal dividing walls which define housings for the cartridges said box bearing means for its quick securing to the aircraft;

(b) an insulating plate rigid with said box and disposed along the cartridge bases, said insulating plate having holes formed to register with said electric detonators of the cartridge bases;

(c) a printed circuit disposed along said insulating plate, this printed circuit having resilient contact studs adapted to engage said electric detonators through said holes of the insulating plate;

(d) a support for a coding circuit, connected to said printed circuit and receiving a removable coding element;

(e) a connector adapted to connect said printed circuit to an electronic control equipment of the aircraft;

(f) a support plate provide with holes registering with said threaded holes of the cartridge bases and recesses for clearing said contact studs of the printed circuit; and (g) fixing bolts adapted to pass through the holes of the support plate and of the cartridge bases for pressing said insulation plate and said printed circuit between the cartridge bases and the support plate.

2. A modular device as claimed in claim 1 wherein said resilient contact studs are provided on a resilient part obtained from a cut-out of the printed circuit in the form of a tongue.

3. A modular device as claimed in claim 1 wherein said box and said insulating plate are formed as a single part.

4. A modular device as claimed in claim 1 wherein a mechanical safety device is provided in the depth of the support plate, said support plate being recessed to this end for containing a flat electric motor actuating dog clutches alternately rotating in front of the bases of each one of said cartridges and adapted to co-act with rotative members provided with ratchet wheel and borne by said cartridge bases.

5. A modular device as claimed in claim 4 wherein each dog clutch is adapted to retract axially against the action of a spring.

* * * * *